US006259796B1

(12) United States Patent
Lin

(10) Patent No.: US 6,259,796 B1
(45) Date of Patent: Jul. 10, 2001

(54) EARPIECE WITHOUT IMPULSE AND HIGH FREQUENCY NOISE

(76) Inventor: Chung-Yu Lin, 29, Tunnel 152, Kuang Hwa 1 Rd., Kaoshiung (TW)

( * ) Notice: Subject to any disclaimer, the term of this patent is extended or adjusted under 35 U.S.C. 154(b) by 0 days.

(21) Appl. No.: 09/350,411

(22) Filed: Jul. 6, 1999

(51) Int. Cl.[7] ..... H04R 25/00
(52) U.S. Cl. ..... 381/371; 381/372; 381/373
(58) Field of Search ..... 381/370, 371, 381/372, 373, 381, 71.6, 71.7, FOR 149, FOR 150, 380, 328; 379/430, 431, 432

(56) References Cited

U.S. PATENT DOCUMENTS 4,239,945 * 12/1980 Atoji et al. ..... 381/371
6,084,976 * 7/2000 Lin ..... 381/371

* cited by examiner

*Primary Examiner*—Huyen Le
(74) *Attorney, Agent, or Firm*—Raymond Y. Chan; David and Raymond Patent Group

(57) ABSTRACT

The present invention relates to an earpiece impulse and high frequency noise which consists of an earpiece housing and a loudspeaker mounted therein, wherein a plurality of sound outlet meshes is mounted on one surface of the earpiece housing; a resonant piece encircling the loudspeaker, and therein a proper side of the resonant piece affixing on the inner surface of the earpiece housing; the lower impulse noise output end according to two output ends of the loudspeaker facing to the sound outlet meshes of the earpiece housing; when the earpiece is used to listen music or hear voice, it can not only prevent impulse noise directly impact to the human ear but also provide a high clarity sound interval produced by the interference of the high and low intensive sound wave.

2 Claims, 4 Drawing Sheets

EARPIECE WITHOUT IMPULSE AND HIGH FREQUENCY NOISE

BACKGROUND OF THE PRESENT INVENTION

1. Field of Invention

The present invention relates to an earpiece, and more particularly to the earpiece with a loudspeaker therein, wherein the present invention not only prevents us from directly impacting the sound pressure to the human ear but also provides us a sound wave without any high frequency noise.

2. Description of Related Arts

In 1990, the National Institutes of Health Consensus Development Conference State announced: "there are about 28 million American have hearing loss problem, among those people, at least one million people have hearing loss from high impact noise environment." Additionally, in 1993, National Ear Care Plan claimed that approximate 1.7% of American Teen who under 18 have hearing disability. Furthermore, in 1997, UT Southwestern Medical Center stated: "approximate 20% of American Teen, between 13–19 have hearing disability. The major cause of the hearing loss is people exposed to the noise especially the impulse noise from the earpiece." People should concern the control of the sound volume while using the traditional earpiece (continuous hearing not more than one hour or six hours per day when sound pressure at 105 dB or 95 dB respectively). In fact, this flash impulse noise contains high sound pressure and may damage the eardrum or middle ear hearing loss. It is called Conductive Hearing Loss. America's medical report recently stated that the percentage of people having the Conductive Hearing Loss is gradually increasing since earpieces are improperly used listen to the hot music such as Rock and Roll.

Moreover, earpiece receives signal from source such as Walkman or communicator devices, and transfers the sound wave to human ear which the perceptible frequency range of human being is about 20 Hz to 20 kHz. In fact, the reproductive resonance of sound wave in above frequency range is not ideal since the source of sound is not come from millions dollars of high-end musical devices but from the walkman or communicator devices. Among these signal from walkman or communicator devices exist lots of feedback or noise, so the noise of 'beep' sounds often found at high frequency range and 'woo' sounds often found at low frequency range.

SUMMARY OF THE PRESENT INVENTION

The main object of the present invention is to provide an earpiece without impulse and high frequency noise, which may reduce the sound pressure directly transmitted to the middle ear; even the impulse noise output from the earpiece, wherein the sound pressure to the middle ear will diminish as much as possible. Accordingly, the present invention can enhance people's listening enjoyment and avoid the Conductive Hearing Loss from the impact of the sound pressure.

Another object of the present invention is to provide an earpiece without impulse and high frequency noise, wherein two different sound waves are generated by the loudspeaker in the earpiece, which overlap with each other to intensify the reproductive resonance at the middle range of frequency of sound wave. Moreover, the present invention can filter and minimize the noise or feedback at higher frequency range.

Another object of the present invention is to provide an earpiece without impulse and high frequency noise, wherein the sound output from the earpiece obtains the functions of resonance intensity and noise attenuating which can purify and clarify the sound.

DETAILED DESCRIPTION OF THE PREFERRED EMBODIMENT

Figure 1:
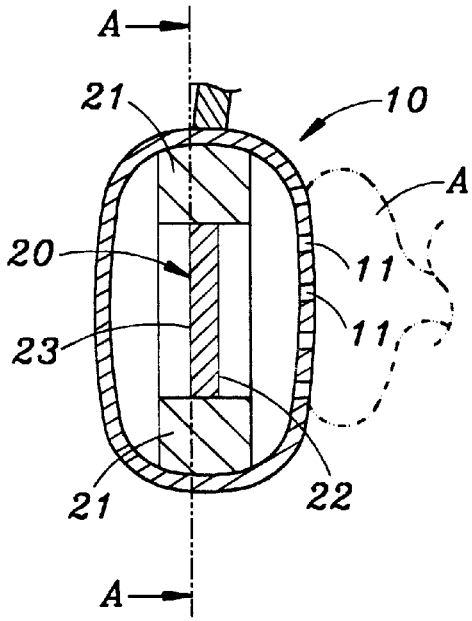
FIG. 1 is a perspective view of an earpiece without impulse and high frequency noise according to a preferred embodiment of the present invention.
Figure 2:
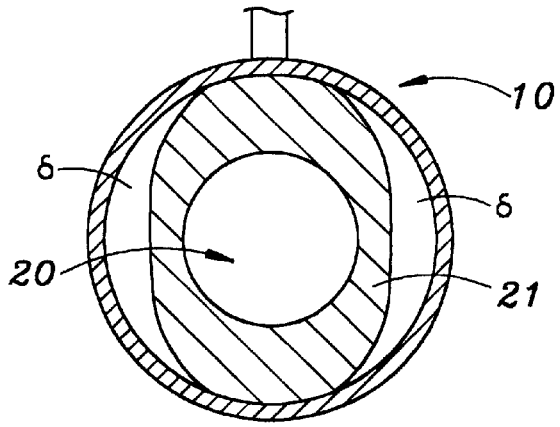
FIG. 2 is a perspective view of FIG. 1 according to cutaway line A—A.

Referring to FIGS. 1 and 2 of the drawings, the earpiece without impulse and high frequency noise in accordance with the present invention comprises an earpiece housing 10 and a loudspeaker 20 mounted therein, wherein a plurality of sound outlet meshes 11 is mounted on the surface of the earpiece housing 10 hanging on the human ear A; a resonant piece 21 encircling the loudspeaker 20, and therein two or more proper sides of the resonant piece 21 affixing on the inner surface of the earpiece housing 10; the lower impulse noise output end according to two output ends of the loudspeaker 20 facing to the sound outlet meshes 11 of the earpiece housing 10, that is, the direction of the low intensive impulse noise will transmit to the sound outlet meshes 11 of the earpiece housing 10 while the direction of the high intensive impulse noise will transmit opposite far from the sound outlet meshes 11 of the earpiece housing 10.

Referring to FIGS. 1 and 2, while the present invention is hanged on the human ear A for listening music or hearing voice, the sound wave, which emitted from the low impulse noise output end, is transmitted to the sound outlet meshes 11 of the earpiece housing 10. This sound wave does not contain any high intensive impulse noise so that human ear will not being hurt by the impact of sudden rise of the high intensive impulse noise. A gap $\delta$ is provided between the earpiece housing 10 and the resonant piece 21. The high-pressure sound wave, which produced by the high impulse noise output end 23, will transmit through the gap and meet the low impulse noise output end 22. The energy of high intensive sound wave will diminish as much as possible during its pathway. The two different intensive sound waves will then interfere with each other. The frequency response will increase, that is the sum of the amplitudes, when two waves are in phase (the difference of two phases is even integral multiple of 360 degree). Contrarily, the frequency response will decrease, that is the difference of the amplitudes, when two waves are out of phase (the difference of two phases is odd integral multiple of 180 degree). By means of the specifically designed resonant piece 21 encircling the loudspeaker 20, the wave after the interference is reproduced. The middle pitch of the sound frequency (200 Hz~4 kHz) will be increased and the high pitch of the sound frequency will be decreased, so as to achieve a high quality of sound interval which is a combination of waves without the high frequency of noise. Furthermore, the resonant piece 21 can be affixed on the earpiece housing by screwing, clipping, assembly, or adhesion.

Figure 3:
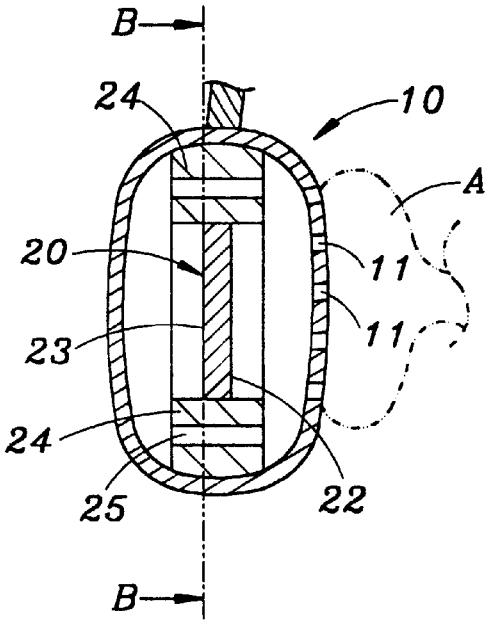
FIG. 3 is a perspective view of an earpiece without impulse and high frequency noise according to the housing of another embodiment of the present invention.
Figure 4:
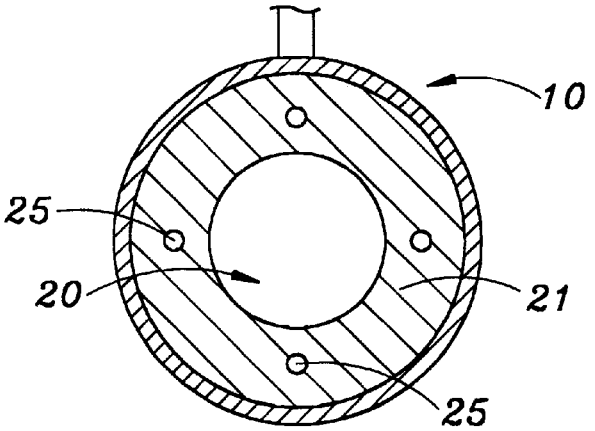
FIG. 4 is a perspective view of FIG. 3 according to cutaway line B—B.

Referring to FIGS. 3 and 4 of the drawings, the outer resonant piece 24 is affixed to the inner surface of the earpiece housing 10, wherein a plurality of hollow meshes 25 is mounted on the resonant piece 24 in a proper location, and thereof the wave produced by the high impulse noise output end 23 will transmit through the hollow meshes 25 and meet the wave produced by the low impulse noise output end 22. A sound is reproduced after two waves interfere with each other and this sound from the earpiece will not contain impulse and high frequency noise.

Figure 5:
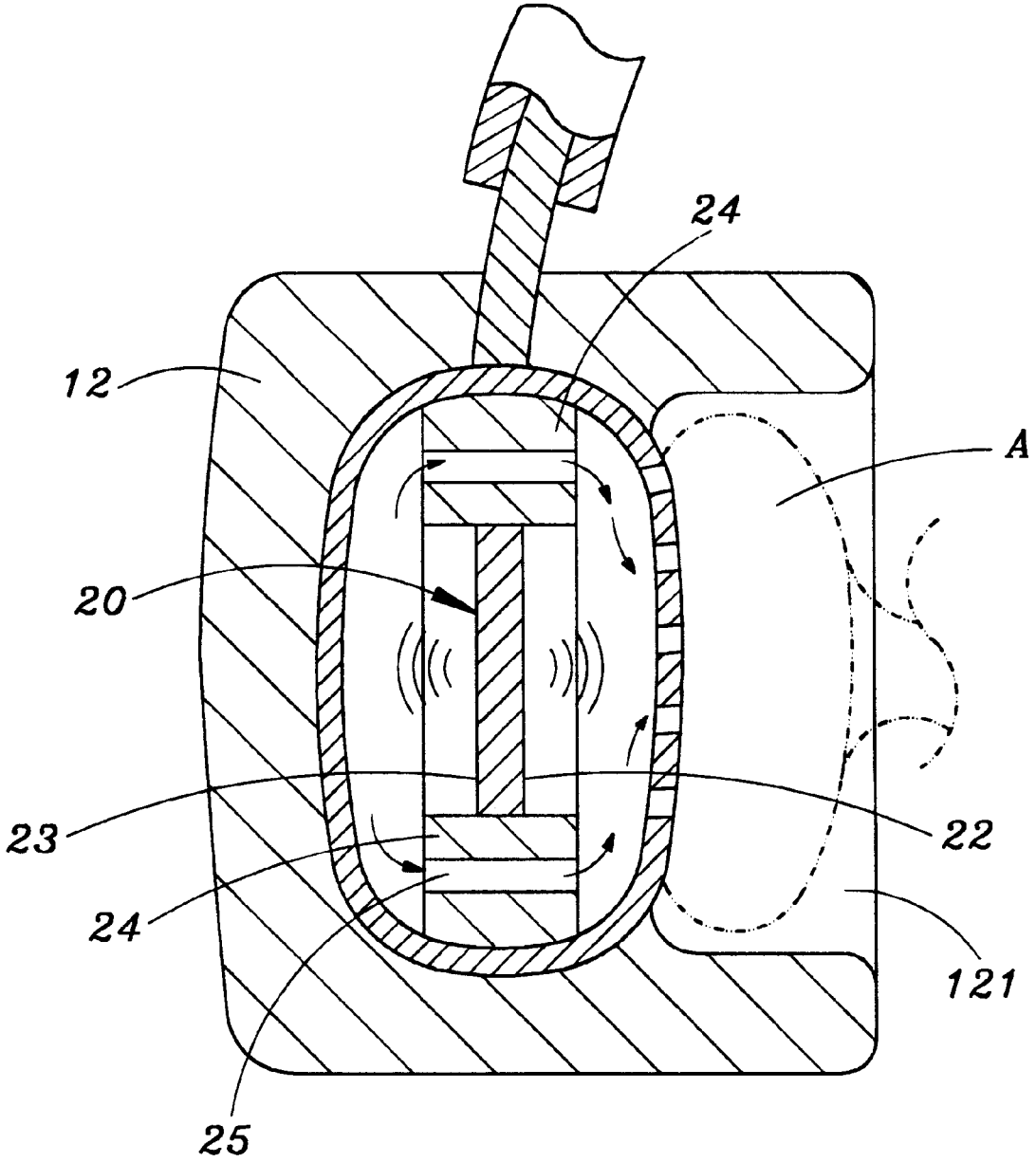
FIG. 5 is a perspective view of an earpiece without impulse and high frequency noise according to the above preferred embodiment of the present invention, illustrating the present invention is covered by a sound insulator.

Referring to FIG. 5, the surroundings of the earpiece housing 10 can be covered by a sound insulator 12 which made of some soft material, wherein a sound outlet groove 121 is mounted on the hood of the sound output meshes 11 of the earpiece housing 10 corresponding to the sound outlet groove thereof; moreover, human external ear can be fully covered by the sound output groove 121, and a side of the sound insulator 12 can affix on the human head; via the design, people will not feel any pressure or uncomfortable when wearing; since the sound insulator 12 covers the human external ear and creates a closed space, the sound from outside will be blocked and cannot interfere with the sound from the loudspeaker.

Figure 6:
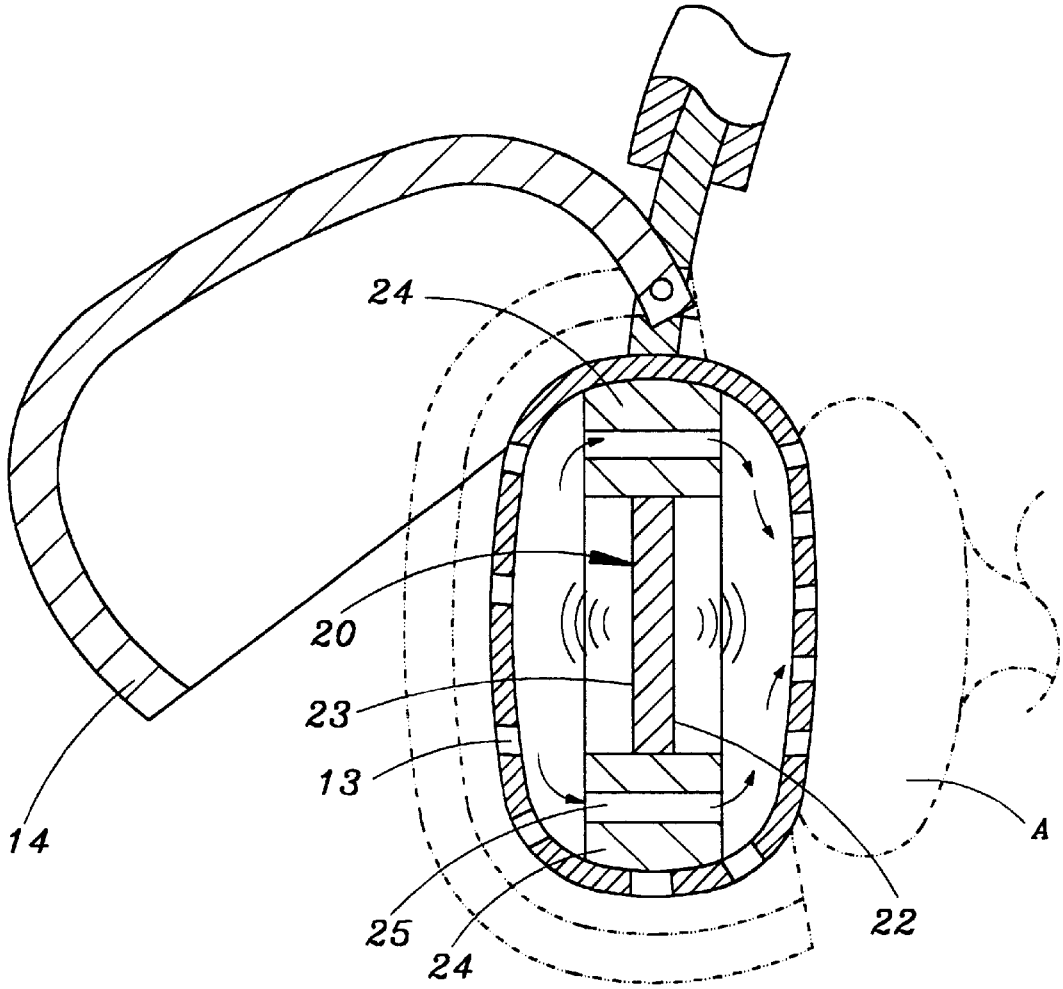
FIG. 6 is a perspective view of an earpiece without impulse and high frequency noise according to the above preferred embodiment of the present invention, illustrating the upper part of the present invention is covered by a sound shelter.

Referring o FIG. 6, a plurality of sound collecting meshes 13 is mounted on the earpiece housing 10 far from the human external ear, so when the earpiece is used to listen music, sound from outside is adapted for pass through the sound collecting meshes 13 in order to improve the ordinary earpiece which the sound will completely block from outside. Moreover, an adjustable sound shelter 14 is affixed on the earpiece housing 10 to cover the sound collecting meshes 13. By means of the specifically designed sound shelter 14, sound from outside will be completely blocked. Besides, the sound shelter 14 on the earpiece housing 10 can be adjusted to a certain position (as shown in FIG. 6 with dotted line indicated) in order to decide whether the sound from outside need to be collected.

What is claimed is:

1. An earpiece without impulse and high frequency noise, comprising an earpiece housing and a loudspeaker mounted therein, a plurality of sound outlet meshes being provided on one surface of said earpiece housing, a resonant piece encircling said loudspeaker, two or more sides of said resonant piece affixing on an inner surface of said earpiece housing, a lower impulse noise output end according to two output ends of said loudspeaker facing to said sound outlet meshes of said earpiece housing, a plurality of sound collecting meshes being provided on the other side of said earpiece housing, and an adjustable sound shelter being affixed on said earpiece housing.

2. An earpiece without impulse and high frequency noise, comprising an earpiece housing and a loudspeaker mounted therein, a plurality of sound outlet meshes being provided on one surface of said earpiece housing, a resonant piece encircling said loudspeaker, an outer of said resonant piece affixing on an inner surface of said earpiece housing, a lower impulse noise output end according to two output ends of said loudspeaker facing to said sound outlet meshes of said earpiece housing, a plurality of hollow meshes being provided on said resonant piece, a plurality of sound collecting meshes being provided on the other side of said earpiece housing, and an adjustable sound shelter being affixed on said earpiece housing.

* * * * *